United States Patent [19]

Weiss

[11] Patent Number: 4,568,078

[45] Date of Patent: Feb. 4, 1986

[54] WEIGHTED LEG EXERCISER

[76] Inventor: Ralph N. Weiss, 2681 13th St. N., Naples, Fla. 33940

[21] Appl. No.: 524,446

[22] Filed: Aug. 18, 1983

[51] Int. Cl.[4] ..... A63B 21/06

[52] U.S. Cl. ..... 272/117; 272/118; 272/134

[58] Field of Search ..... 272/96, 118, 116, 117, 272/134, 144, 130; 128/25 R, 25 B

[56] References Cited

U.S. PATENT DOCUMENTS

| | | | |
|---|---|---|---|
| 2,819,081 | 1/1958 | Touraine | 272/127 X |
| 3,294,399 | 12/1966 | Cugliari | 272/117 |
| 3,495,824 | 2/1970 | Cuinier | 272/130 |
| 4,149,713 | 4/1979 | McLeod | 272/130 X |

*Primary Examiner*—Richard J. Apley
*Assistant Examiner*—William R. Browne
*Attorney, Agent, or Firm*—Hauke and Patalidis

[57] ABSTRACT

An apparatus for exercising the rotator muscles of the leg of a person. The apparatus has a frame supporting an adjustable seat, a rotatable knee support cradle in which the knee of a user is securely strapped for preventing flexion of the leg at the knee joint, the ankle of the user resting on a rotatable ankle support cradle. The ankle cradle is adjustable in distance relative to the knee cradle. Rotation of the knee cradle is opposed by suspended weights or by any other appropriate energy absorbing device.

31 Claims, 11 Drawing Figures

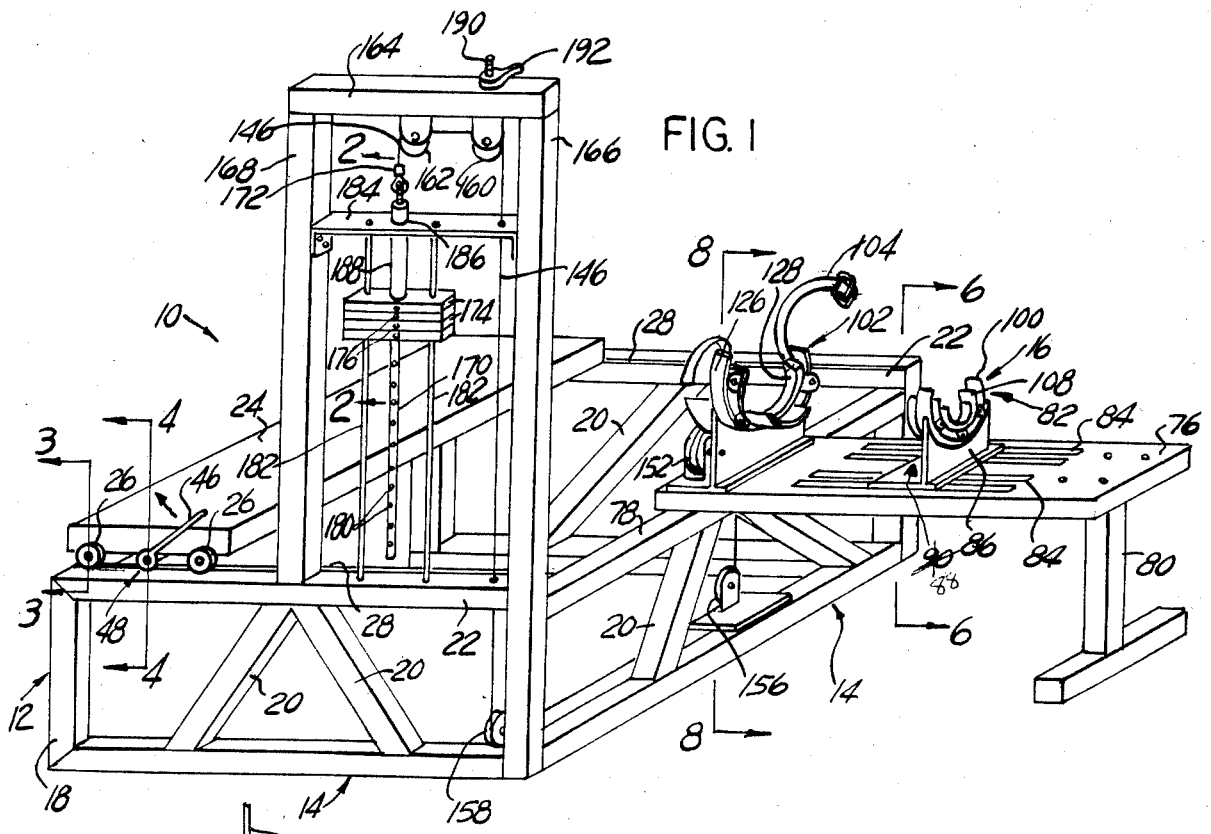
FIG. 1
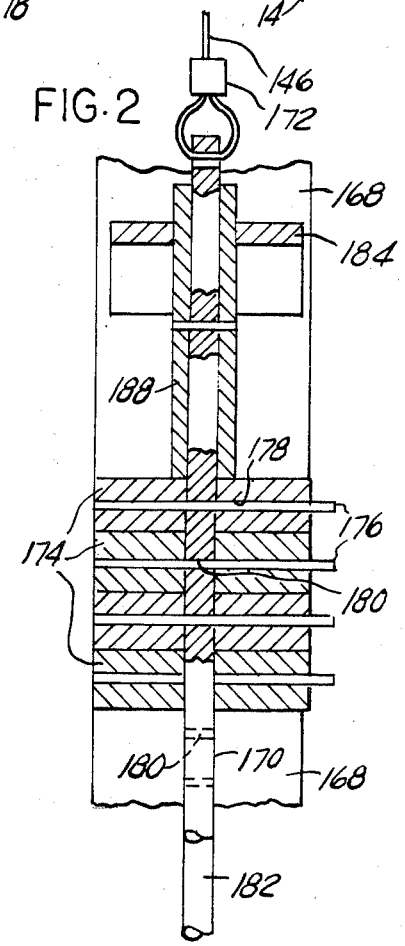
FIG. 2
FIG. 3
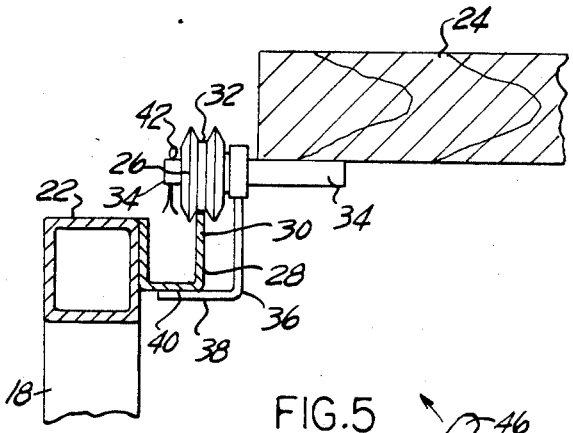
FIG. 5
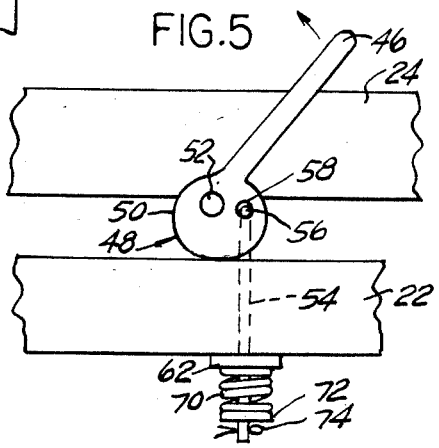

WEIGHTED LEG EXERCISER

BACKGROUND OF THE INVENTION

The present invention relates to an exercising apparatus in general, and more particularly to a novel leg rotator exercising apparatus for primarily exercising the leg rotator muscles of a user.

Many body muscle exercising apparatus have been devised in the past, either for exercising arm muscles or leg muscles, but such apparatus are generally designed to exercise muscles in extension and flexion. However, it is sometimes desirable to exercise a leg, for example, in rotation while preventing the leg from bending at the knee, such as to force the user to activate only his, or her, thigh rotator muscles. Such apparatus are used for muscular rehabilitation or therapy, or simply for muscular build-up associated with physical exercise or special purpose training.

In order to be effective, and for providing progressive increase of the effort required during exercise, means are generally provided for progressively increasing the opposing load or force, by way of weights or springs, or by way of an energy absorbing unit, as a user progresses in developing the strength of his, or her, muscles.

Exercising apparatus of all types must meet the requirement of being adjustable to different individual sizes and more particularly leg exercising apparatus must be adjustable to accommodate diverse user's femur and tibia lengths.

SUMMARY OF THE INVENTION

The present invention provides a leg rotation exercising apparatus enabling a user's leg to be fully extended and supported at the knee and at the ankle such as to enable rotation of a leg, without friction, from the hip to the foot, and without undue stress or bending, and permitting an adjustable load or an adjustable energy absorbing unit to be connected to the leg in such manner that the leg rotator muscle effort is applied against the load or energy absorbing device.

Furthermore the present invention provides a leg rotation exercising apparatus which is adjustable to diverse femur and tibia lengths of various users, and which provides a comfortable support for the leg of a user requiring only rotating effort to be applied to the leg. The rotating effort is absorbed by an energy absorbing device which permits progressive increase of the effort required for rotating the leg against the opposing load or force provided by the energy absorbing device.

Further objects and advantages of the present invention will become apparent to those skilled in the art when the following description of the best mode contemplated for practicing the invention is read in conjunction with the accompanying drawing wherein like reference numerals refer to like or equivalent parts, and in which:

BRIEF DESCRIPTION OF THE DRAWINGS

FIG. 1 is a schematic perspective view of an exercising apparatus according to the present invention;

FIG. 2 is a partial section thereof along line 2—2 of FIG. 1;

FIG. 3 is a partial section thereof along line 3—3 of FIG. 1;

FIG. 5 is a partial elevation view thereof from line 5—5 of FIG. 4;

DETAILED DESCRIPTION OF THE PREFERRED EMBODIMENTS

Figure 4:
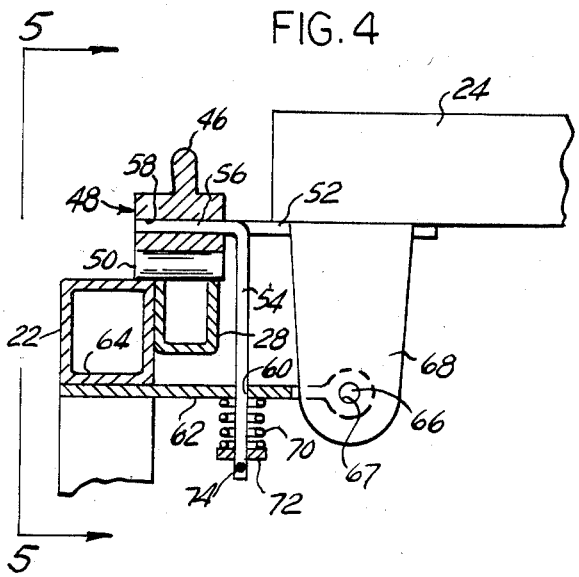
FIG. 4 is a partial section thereof along line 4—4 of FIG. 1.

Referring to the drawing, and more particularly to FIG. 1 thereof, there is illustrated an exercising apparatus according to the present invention, generally designated by reference numeral 10. The apparatus 10 comprises a substantially rectangular frame 12 made of metallic tubular beams appropriately cut to length and welded for forming a ground engaging frame portion 14 and an upper frame portion 16, upright members 18 being provided at each corner for supporting the upper frame portion 16 away from the ground supported frame portion 14. Appropriate reinforcing members 20 are disposed between the lower frame portion 14 and the upper frame portion 16, as shown, and welded in position or otherwise attached such as to provide a sturdy and rigid frame 12.

The apparatus upper frame portion 16 is provided with two substantially parallel lateral rail members 22 supporting a longitudinal adjustable seat 24. The seat 24 is a generally rectangular bench made of wood or metal supported at each side by a pair of rollers 26. As best shown at FIG. 3, each lateral support rail member 22 is provided, on its interior surface, with a U-shaped channelway 28, welded or otherwise fastened to the surface of the lateral rail member 22, the roller 26 being in the form of a V-grooved roller permitting the top edge of the outer sidewall 30 of the U-shaped channelway to engage the peripheral groove 32 of the roller 26. The V-grooved roller 26 rotates around a stationary shaft 34 welded or otherwise fastened to the bottom of the seat 24. An L-shaped bracket 36 attached to the stationary shaft 34 has a sideway projecting portion 38 in slidable engagement with the outer surface of the bottom portion 40 of the U-shaped channelway 28, such as to prevent the top edge of the channelway sidewall 30 from becoming disengaged from the groove 32 in the V-grooved roller 26. A cotter pin 42 holds the V-grooved roller 26 rotatably engaged over the end of the shaft 34.

The seat 24 may be positioned alongside the frame lateral rail members 22 to accommodate persons of different statures, after releasing the seat by pulling, in the direction of the arrow, FIG. 1, a release lever 46. After appropriately positioning the seat 24, the seat is automatically locked in position by means of one, or preferably two, i.e one on each side of the seat, wedging cams 48, each releasable by a release lever 46. As shown in details at FIGS. 4–5, each wedging cam 48 takes the form of an eccentric member 50 rotatably supported by a pin 52 mounted below the seat 24 between the corresponding two lateral support V-grooved rollers 26, FIG. 1. A rod 54 has a bent over end portion 56 disposed through a lateral bore 58 through the eccentric member 50, the other end of the rod 54 being passed through an appropriate aperture 60 in a plate 62 disposed substantially horizontally with an end face 64 in engagement with the lower surface of the lateral rail member 22. The other end of the plate 62 is bifurcated and provided with an apertured eyelet 66 permitting the plate 62 to pivot relative to a downwardly extending bracket 68 mounted below the seat 24, a pivot pin 67 being mounted through the apertured eyelet in the bifurcated end of the plate 62 and a corresponding aperture in the bracket 68. A compressed coil spring 70 is disposed around the end of the rod 54 between the plate 62 and a retaining washer 72. A cotter pin 74, disposed through a transverse hole in the rod 54 holds the retainer washer 72 in position.

The seat 24 is thus locked in any adjusted position by releasing the lever 46 in the direction opposite to that of the arrow, FIGS. 1 and 5, which causes the camming eccentric member 50 to be wedged against the top of the side rail member 22 under the pulling action of the coil spring 70. The coil spring 70 constantly applies the end of the plate 62 against the bottom surface of the lateral rail member 22, even when the seat 24 is unlocked, such that the seat must be displaced against the slight drag caused by the frictional engagement of the end of the plate 62 with the bottom surface of the lateral rail member 22. It will be readily appreciated that locking mechanisms other than the one described herein may be used for locking the seat 24 in its adjusted position.

As shown at FIG. 1, a platform 76 is fixedly supported at one end from the frame 12 by a cross-beam member 78 forming part of the upper frame portion 16. The platform 76 is supported from the ground at its other end by a leg 80. The platform 76 extends outwardly from the apparatus frame 12 and its longitudinal axis is substantially perpendicular to the lateral axes of the seat 24. An ankle cradle 82 is adjustably mounted on the top of the platform 76 which is provided, for that purpose, with a pair of parallel, longitudinally extending, slots 84. The ankle cradle 82 is supported by a vertically disposed support plate 86, to the top of which it is, for example, welded, a horizontally disposed base plate 88 being welded, or otherwise fastened, to the bottom of the cradle support plate 86, at right angle thereto. As shown in detail at FIG. 6, the ankle cradle 82 is adjustably clamped on the top of the platform 76 by means of a pair of releasable clamping means 90 consisting each of a carriage bolt 92 provided at one end with a shouldered retainer 94 disposed in the platform slot 84 with its shouldered portion 96 engageable with the lower surface of the platform 76, the bolt 92 being passed through an aperture 98 in the base plate 88 with its threaded end engaged in the threaded bore or a wing- or lever-nut 100. As the shouldered retainer 94 is solidly attached, such as by welding, to the body of the bolt 92, and as the body of the retainer 94 is, for example square or hexagonal in section, when the clamping wing- or lever-nut 100 is rotated in one direction, the ankle cradle base plate 88 is unclamped and, consequently the ankle cradle 82 may be located in any appropriate position along the slots 84 for adjustment towards and away from a knee cradle 102, FIG. 1, fixedly mounted on the platform 76 proximate its end supported by the frame cross-beam 78. Once a correct position is reached for the ankle cradle 82, the wing- or lever-nut 100 is tightened.

In use of the apparatus 10 of the invention, a person sits on the seat 24 after adjusting the seat 24 in position relative to the knee cradle 102 such that the back of his, or her, knee joint rests on the knee cradle 102 and may be strapped in the knee cradle 102 by means of a strap 104. The ankle of the person is supported by the ankle cradle 82 which is adjusted in position along the slot 84 of the platform 76 according to the length of the person's leg from the knee to the ankle.

Figure 6:
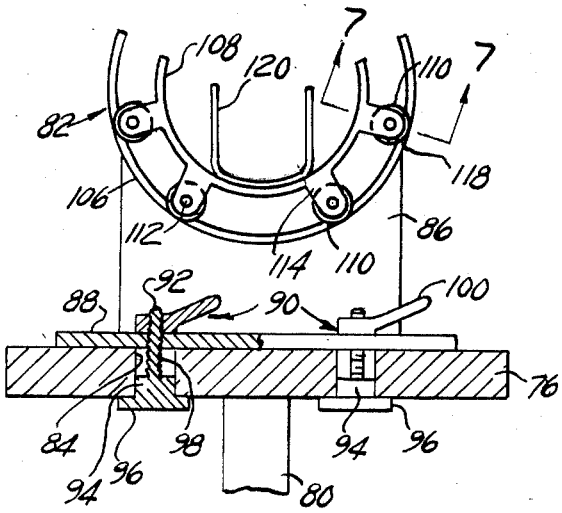
FIG. 6 is a partial section and elevation view thereof from line 6—6 of FIG. 1.
Figure 7:
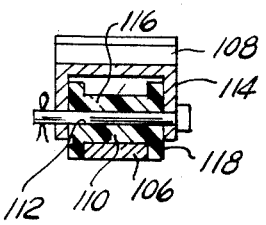
FIG. 7 is a section along line 7—7 of FIG. 6.

Referring once again to FIG. 6 and to FIG. 7, the ankle cradle 82 comprises a partially annular plate 106 welded to the top of the ankle cradle support plate 86, and extending about an arc of 180 degrees to 250 degrees, for example, although it will be appreciated that the annular plate 106 could be made as a full circle annular member. The annular plate 106 defines an outer race for a partially annular rocker member 108 disposed concentric to the annular plate or race 106, a plurality of rollers 110 being rotatably mounted on the bottom of the rocker member 108 each around a pin 112 passed through appropriate aligned apertures in downwardly directed mounting flanges 114 formed integral with the rocker member 108. Each roller 110 has a cylindrical body portion 116, FIG. 7, in rolling engagement with the surface of the annular plate or race 106 and a pair of lateral flanges 118 projecting beyond the lateral edges of the annular plate or race 106 for longitudinal guidance of the rocker member 108 relative to the annular plate or race 106. A strap, not shown, or a U-shaped support member 120 as shown, FIG. 6, is provided, or both, such that rotation of a person's ankle causes rotation of the rocker member 108 relative to the stationary annular plate or race 106.

Figure 9:
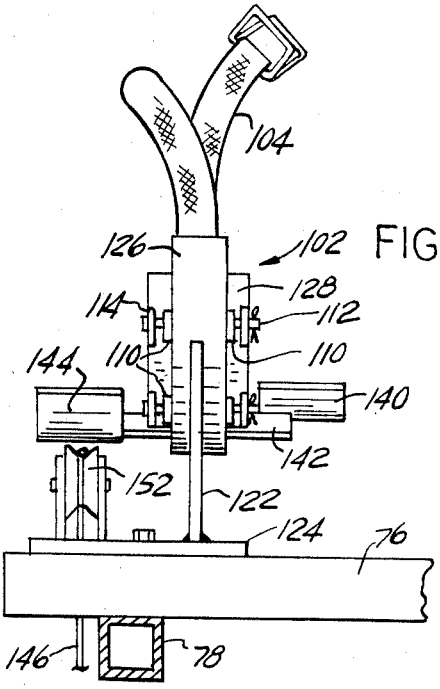
FIG. 9 is a partial side elevation view thereof from line 9—9 of FIG. 8.
Figure 8:
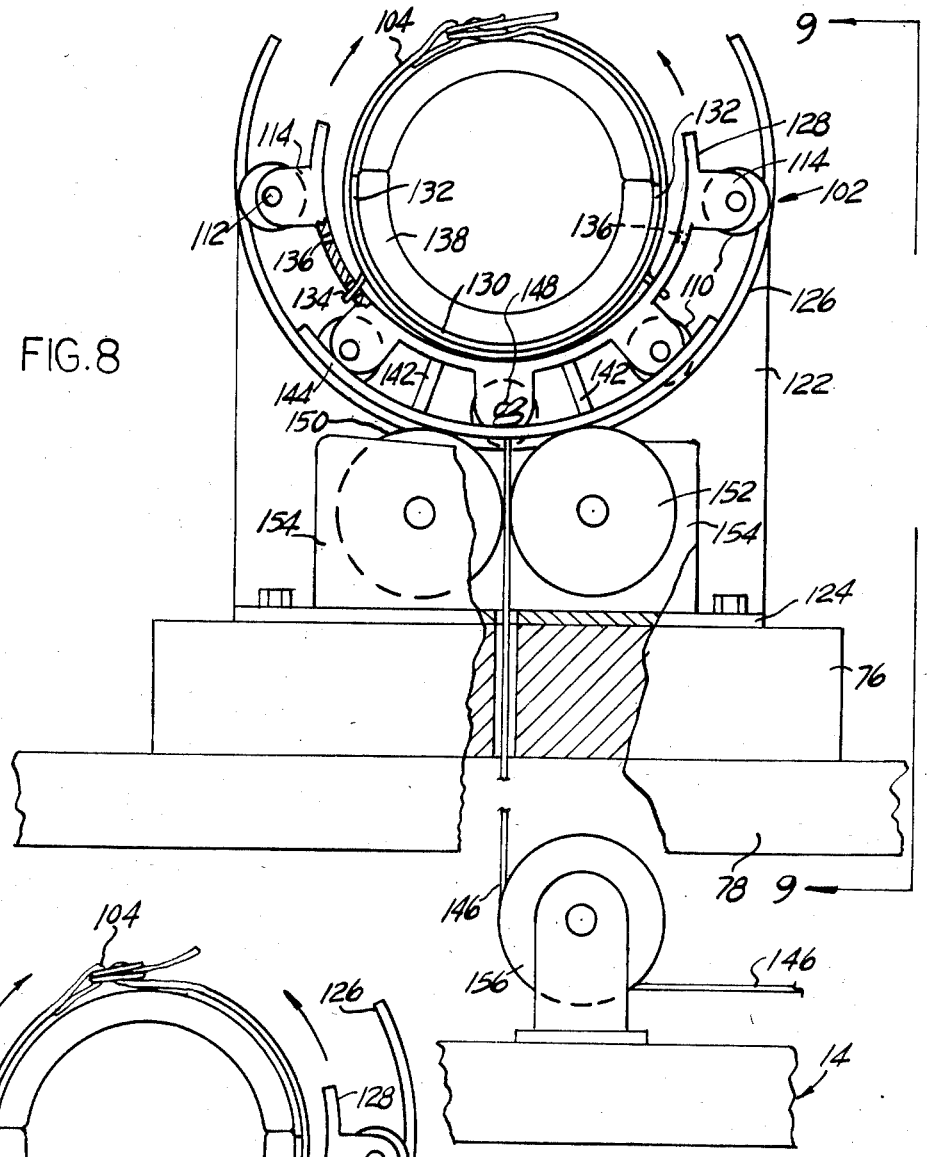
FIG. 8 is a partial elevation view thereof along line 8—8 of FIG. 1.

As shown in detail at FIGS. 8–9, the knee cradle 102 is supported by a support plate 122 on the top of which it is appropriately mounted, such as by welding. The support plate 122 is in turn mounted on a base plate 124 fixedly bolted to the platform 76. The structure of the knee cradle 102 is generally the same as the structure of the ankle cradle 82, at a larger scale however for accommodating the larger scale of the knee of a person as compared to his or her ankle. The knee cradle 102 comprises a partially annular plate defining an annular race 126 welded on the top of the support plate 122 and an annular rocker member 128 rotatable within the annular plate or race 126 as being supported therefrom by flanged rollers 110 rotatably mounted between lateral flanges or ears 114 and rotatably supported by pins 112. The strap 104 is mounted on the interior surface of the rocker 128 by way of a plate 130, attached to the rocker member 128 by any convenient means such as screws, not shown, the strap 104 being passed under each of a pair of extension plates 132, FIG. 8, each provided with a pair of end lateral pins 134 each engaged through an opening 136 in the rocker member 128, the distance separating the pins 134 being slightly larger than the width of the strap 104. A plurality of pairs of apertures 136 are provided to permit locating the extension plates 132 at different positions relative to the knee rocker member 128 to accommodate different knee sizes. In use, the knee of a person is clamped in the knee cradle 102 by way of the strap 104, elastomeric pads 138 being preferably placed on the belt attaching plate 130, on the swingable extension plates 132, and below the strap 104, if so desired, to protect the skin of the person and to provide comfortable clamping of the knee within the knee rocker member 128, such that rotation of the leg around a substantially horizontal axis causes rotation of the knee rocker member 128, the ankle being supported by the rotatable ankle rocker member.

The knee rocker member 128 is preferably provided on one side, FIG. 9, with a curved, or trough-shaped, leg support extension 140 mounted on the end of a pair of support bars 142 affixed in any convenient manner to the rocker member 128. The support bars 142 project on the other side of the rocker member 128 and a curved extension plate 144, FIGS. 8 and 9, is fixedly mounted below the support bars 142 at their projecting end. The curved extension plate 144 has appropriate means, substantially at its center for attaching the end of a cable 146, for example by being provided with an aperture through which the end of the cable 146 is passed, the end of the cable being provided with an appropriate retainer 148 such as a clip or the like. The cable 146 passes between two vertically disposed pulleys 150 and 152 rotatably supported by a bracket 154 affixed to the top of the support base 124. After passing between the pulleys 150 and 152, the cable 146 is routed around a pulley 156 mounted below the pulleys 150–152 on the apparatus lower frame portion 14, and around another pulley 158, FIG. 1, mounted at a corner of the apparatus lower frame portion 14 from which the cable 146 is routed through a pair of additional pulleys 160 and 162 mounted under a cross-member 164 connecting at their top a pair of parallel upright posts 166 and 168 extending above the apparatus frame 12. The end of the cable 146 is attached to a weight support bar 170 by any appropriate means such as a loop connector 172.

As shown at FIG. 1, and in further detail at FIG. 2, a plurality of weights 174 are removably mounted on the weight support bar 170 by means of pins 176 each passed through a bore 178 disposed transversely through each weight 174 and a corresponding bore 180 in the weight support bar 170. Preferably, the weights 174 have an appropriate vertical bore proximate each of their ends for sliding over a pair of parallel guide rods 182 mounted between the corresponding lateral rail member 22 and a plate 184 affixed at each end to the upright posts 166 and 168 below the cross-member 164. The plate 184 has an aperture 186 allowing passage therethrough of the upper portion of the weight supporting bar 170 which is preferably provided between the uppermost of the weights 174 and the loop connector 172 with a spacer sleeve 188. Unattached weights, not shown, are simply resting on the top of the lateral rail member 22. Each weight 174 may be between 500 gr. and 1,000 gr.

It can thus be seen that when a person desires to exercise his or her leg rotator muscles, after appropriate adjustment of the position of the ankle cradle 82 and of the seat 24, with the knee of the person disposed in the rocker member 128 of the knee cradle 102 and appropriately fastened therein by the strap 104, and the ankle resting within the U-shaped retainer 120 of the ankle rocker member 108 of the ankle cradle 82, rotation of the leg, causing rotation of the knee rocker 128, causes in turn the weights 174 to be lifted as a result of the shortening of the cable 146 due to the angular displacement of the rocker 128 causing the end portion of the cable 146 to wrap either around the pulley 150 or the pulley 152. Progressive increase of the load or force opposing rotation of the leg is provided by progressively adding weights 174 to the weight support bar 170.

In the structure of the apparatus 10 illustrated at FIGS. 1–9, it is to be noted that the knee rocker member 128 is further supported in rotation by the curved extension 144 preferably engaging the peripheries of the pulleys 150 and 152, and that the pulley 160 is attached to the cross-member 164 mounted on the top of the upright post 166 by way of a threaded rod 190 and wing- or lever-nut 192, such that the vertical position of the pulley 160 is made adjustable for compensating variations in length of the cable 146.

Figure 11:
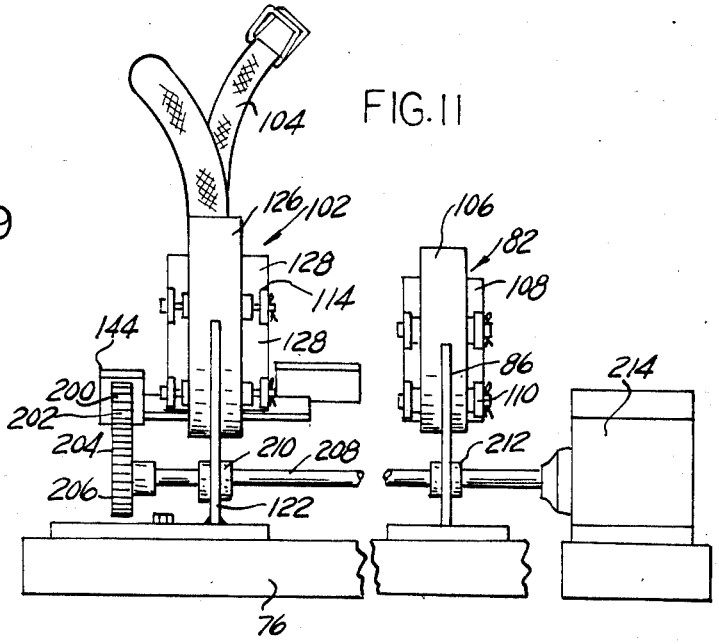
FIG. 11 is a side elevation view from line 11—11 of FIG. 10.
Figure 10:
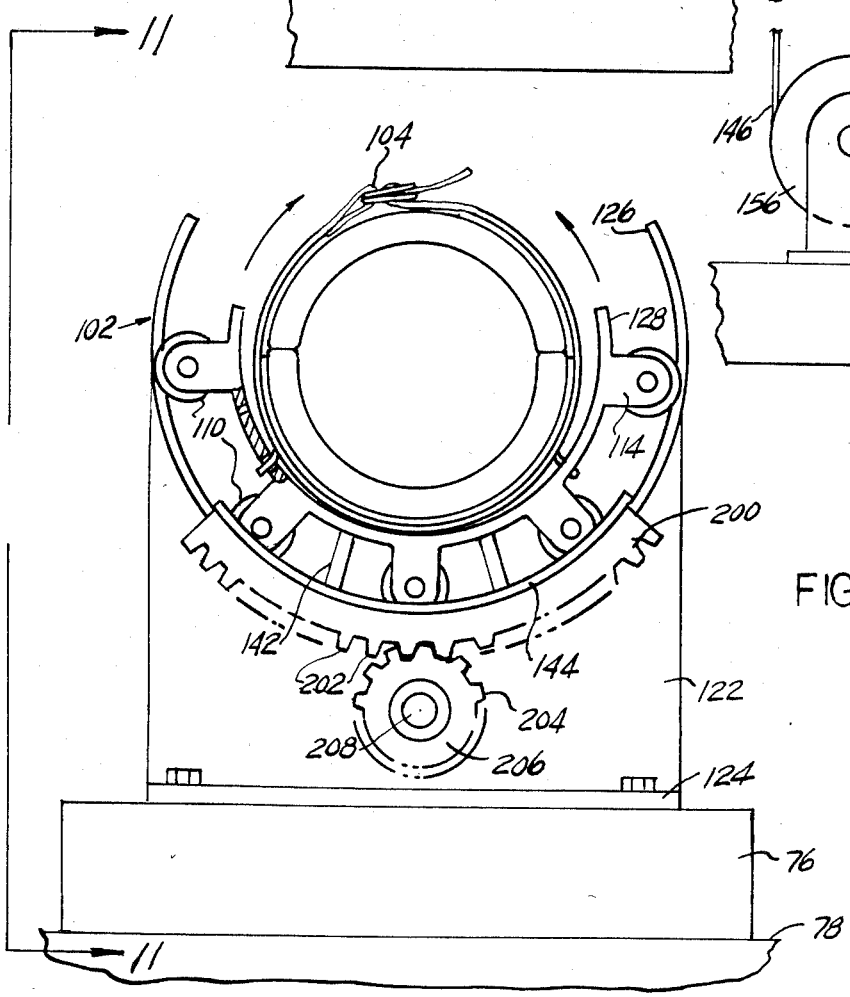
FIG. 10 is a partial view similar to FIG. 8 but showing a modification of the apparatus of the present invention.

Instead of a cable, pulley and weight arrangement for loading the rocker member 128 of the knee cradle 102, a spring or fluid resistant loading device may advantageously be used, which permits to substantially reduce the weight of the apparatus 10 and to do away with the upright posts 166–168, and the weight attachment and guide structure attendant therewith. An example of such simplified structure is illustrated at FIGS. 10–11 wherein the knee rocker curved extension plate 144 is provided with a circular rack 200 mounted below the extension plate 144 by any appropriate means such as welding, brazing or by being bolted therebelow. The rack 200 has teeth 202 meshing with the teeth 204 of a pinion 206 keyed on the end of a rotatable shaft 208. The shaft 208 journals through appropriate bearings 210 and 212 disposed respectively through the knee cradle support plate 122 and the ankle cradle support plate 86. The other end of the shaft 208 is connected to the rotor of a fluid resistant, spring resistant, or friction resistant unit 214, FIG. 11, which provides an opposing force in both directions of rotation of the shaft 208, and consequently of the rocker member 128 of the knee cradle 102. Fluid resistant or friction resistant units are well known in the art, as disclosed for example in U.S. Pat. Nos. 3,495,824 and 2,819,081.

It can thus be seen that the exercising apparatus 10 of the invention provides a convenient means for exercising the rotator muscles of a person, which is adjustable to the femur length and to the tibia length of the person, which provides exclusively torsional leg exercising and which prevents knee flexion motions.

Having thus described the present invention by way of examples of structure well designed to achieve the objects of the invention, modifications thereof will be apparent to those skilled in the art,

What is claimed as new is as follows:

1. An apparatus for exercising the leg rotator muscles of a user, said apparatus comprising a frame, a seat supported by said frame, a knee cradle supported by said frame, means for strapping a knee of said user in said knee cradle, means for adjusting the relative distance separating said seat from said knee cradle, an ankle cradle for supporting the user's leg proximate the ankle, means for adjusting the relative distance separating said knee cradle and said ankle cradle, wherein the leg of said user being supported in said knee cradle and said ankle cradle is substantially in a horizontal position, pivotal means enabling said user to rotate said knee cradle around a substantially horizontal axis, and means for applying an adjustable force opposing said rotation of said knee cradle, wherein said knee cradle comprises a partially annular support race member, a partially annular rocker member, and a plurality of support and guide rollers disposed between said rocker member and said rocker support race member.

2. The apparatus of claim 1 wherein said knee cradle is in a fixed position and said seat is adjustable in position relative to said knee cradle.

3. The apparatus of claim 2 wherein said ankle cradle is adjustable in position relative to said knee cradle.

4. The apparatus of claim 1 wherein said ankle cradle comprises a partially annular support race member, a partially annular rocker member, and a plurality of support and guide rollers disposed between said rocker member and said rocker support race member.

5. The apparatus of claim 4 wherein each of said ankle cradle rollers is pivotably supported from said ankle cradle rocker member, each of said ankle cradle rollers having a flange at each end adapted to abut against a lateral surface of said ankle cradle rocker support race member.

6. The apparatus of claim 1 wherein said means for applying an adjustable opposing force comprises at least one suspended weight and a pulley and cable arrangement connecting said suspended weight to said knee cradle whereby rotation of said knee cradle in any direction from a reference position lifts said suspended weight.

7. The apparatus of claim 6 wherein said weight is removably attached to a rod attached to an end of said cable.

8. The apparatus of claim 1 wherein said means for applying an adjustable opposing force comprises at least one suspended weight and a pulley and cable arrangement connecting said suspended weight to said rocker member whereby rotation of said rocker member in any direction from a reference position lifts said suspended weight.

9. The apparatus of claim 1 wherein said means for applying adjustable opposing force is an energy absorbing unit having an input, and further comprising a rack mounted on said rocker member, a pinion meshing with said rack, and means connecting said pinion to the input of said energy absorbing unit.

10. The apparatus of claim 1 wherein said seat is adjustably supported by a pair of lateral parallel rail members forming part of said frame, said seat being provided with grooved rollers having a groove engaged on a top edge of a U-shaped channel attached to the side of said lateral rail members.

11. The apparatus of claim 10 further comprising seat locking means for locking said seat in an appropriate position along said lateral rail members.

12. The apparatus of claim 11 wherein said locking means comprises a camming member in the form of an eccentric supported from below said seat, biasing means urging said eccentric member in rotation for normally engaging a portion of the peripheral surface of said eccentric member with said lateral rail member, and manually operated lever means integral with said eccentric member for releasing the peripheral surface of said eccentric member from engagement with said lateral rail member.

13. The apparatus of claim 1 further comprising elastomeric pads disposed on said knee rocker member and an adjustable strap for holding said knee in said knee rocker member.

14. The apparatus of claim 1 wherein each of said rollers is pivotably supported from said rocker member, each of said rollers having a flange at each end adapted to abut against a lateral surface of said rocker support race member.

15. An apparatus for exercising the leg rotator muscles of a user, said apparatus comprising a frame, a seat supported by said frame, a knee cradle supported by said frame, means for strapping a knee of said user in said knee cradle, means for adjusting the relative distance separating said seat from said knee cradle, an ankle cradle for supporting the user's leg proximate the ankle, means for adjusting the relative distance separating said knee cradle and said ankle cradle, wherein the leg of said user being supported in said knee cradle and said ankle cradle is substantially in a horizontal position, pivotal means enabling said user to rotate said knee cradle around a substantially horizontal axis, and means for applying an adjustable force opposing said rotation of said knee cradle, wherein said ankle cradle comprises a partially annular support race member, a partially annular rocker member, and a plurality of support and guide rollers disposed between said rocker member and said rocker support race member.

16. The apparatus of claim 15 wherein said knee cradle is in a fixed position and said seat is adjustable in position relative to said knee cradle.

17. The apparatus of claim 16 wherein said ankle cradle is adjustable in position relative to said knee cradle.

18. The apparatus of claim 15 wherein said means for applying an adjustable opposing force comprises at least one suspended weight and a pulley and cable arrangement connecting said suspended weight to said knee cradle whereby rotation of said knee cradle in any direction from a reference position lifts said suspended weight.

19. The apparatus of claim 18 wherein said weight is removably attached to a rod attached to an end of said cable.

20. The apparatus of claim 15 wherein said means for applying an adjustable opposing force comprises at least one suspended weight and a pulley and cable arrangement connecting said suspended weight and a pulley and cable arrangement connecting said suspended weight to said rocker member whereby rotation of said rocker member in any direction from a reference position lifts said suspended weight.

21. The apparatus of claim 15 wherein said means for applying adjustable opposing force is an energy absorbing unit having an input, and further comprising a rack mounted on said rocker member, a pinion meshing with said rack, and means connecting said pinion to the input of said energy absorbing unit.

22. The apparatus of claim 15 wherein said seat is adjustably supported by a pair of lateral parallel rail members forming part of said frame, said seat being provided with grooved rollers having a groove engaged on a top edge of a U-shaped channel attached to the side of said lateral rail members.

23. The apparatus of claim 22 further comprising seat locking means for locking said seat in a appropriate position along said lateral rail members.

24. The apparatus of claim 23 wherein said locking means comprises a camming member in the form of an eccentric supported from below said seat, biasing means urging said eccentric member in rotation for normally engaging a portion of the peripheral surface of said eccentric member with said lateral rail member, and manually operated lever means integral with said eccentric member for releasing the peripheral surface of said eccentric member from engagement with said lateral rail member.

25. The apparatus of claim 15 further comprising elastomeric pads disposed on said knee cradle and an adjustable strap for holding said knee in said knee cradle.

26. The apparatus of claim 15 wherein each of said rollers is pivotably supported from said rocker member, each of said rollers having a flange at each end adapted to abut against a lateral surface of said rocker support race member.

27. An apparatus for exercising the leg rotator muscles of a user, said apparatus comprising a frame, a seat supported by said frame, a knee cradle supported by said frame, means for strapping a knee of said user in said knee cradle, means for adjusting the relative distance separating said seat from said knee cradle, an ankle cradle for supporting the user's leg proximate the ankle, means for adjusting the relative distance separating said knee cradle and said ankle cradle, wherein the leg of said user being supported in said knee cradle and said ankle cradle is substantially in a horizontal position, pivotal means enabling said user to rotate said knee cradle around a substantially horizontal axis, and means for applying an adjustable force opposing said rotation of said knee cradle, wherein said seat is adjustably supported by a pair of lateral parallel rail members forming part of said frame, said seat being provided with grooved rollers having a groove engaged on a top edge of a U-shaped channel attached to the side of said lateral rail members, and locking means are provided for locking said seat in an appropriate position along said lateral rail members, said locking means comprising a camming member in the form of an eccentric supported from below said seat, biasing means urging said eccentric member in rotation for normally engaging a portion of the peripheral surface of said eccentric member with said lateral rail member, and manually operated lever means integral with said eccentric member for releasing the peripheral surface of said eccentric member from engagement with said lateral rail member.

28. The apparatus of claim 27 wherein said means for applying an adjustable opposing force comprises at least one suspended weight and a pulley and cable arrangement connecting said suspended weight to said knee cradle whereby rotation of said knee cradle in any direction from a reference position lifts said suspended weight.

29. The apparatus of claim 28 wherein said weight is removably attached to a rod attached to an end of said cable.

30. The apparatus of claim 27 wherein said means for applying adjustable opposing force is an energy absorbing unit having an input, and further comprising means connecting said knee cradle to the input of said energy absorbing unit.

31. The apparatus of claim 27 further comprising elastomeric pads disposed on said knee cradle and an adjustable strap for holding said knee in said knee cradle.

* * * * *